US006279234B1

(12) United States Patent
Chaouachi et al.

(10) Patent No.: US 6,279,234 B1
(45) Date of Patent: Aug. 28, 2001

(54) HAIR-CUTTING SYSTEM INCLUDING A HAIR-CUTTING APPARATUS AND INCLUDING A COMB SECTION WHOSE ANGULAR POSITION IS CONTINUALLY ADJUSTABLE WITH RESPECT TO THE HAIR-CUTTING POSITION

(75) Inventors: Jaleleddine Chaouachi; Andreas Hauer, both of Klagenfurt; Peter Schaller, St. Veit an der Glan, all of (AT)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/379,059

(22) Filed: Aug. 23, 1999

(30) Foreign Application Priority Data

Aug. 21, 1998 (EP) ..... 98890247

(51) Int. Cl.[7] ..... B26B 19/20
(52) U.S. Cl. ..... 30/201; 30/200
(58) Field of Search ..... 30/195, 200, 201, 30/202, 233, 233.5

(56) References Cited

U.S. PATENT DOCUMENTS

| | | | | |
|---|---|---|---|---|
| 1,895,183 | * | 1/1933 | Wahl | 30/201 |
| 2,013,279 | * | 9/1935 | Maleev | 30/202 |
| 2,480,920 | * | 9/1949 | Gullong | 30/202 |
| 2,593,168 | * | 4/1952 | Monyhan | 30/201 |
| 2,768,438 | * | 10/1956 | Coggins et al. | 30/200 |
| 3,060,574 | | 10/1962 | Thomas | 30/202 |
| 3,280,456 | * | 10/1966 | Erickson et al. | 30/201 |
| 4,557,050 | | 12/1985 | Haraguchi et al. | 30/195 |
| 5,898,999 | * | 5/1999 | Chaouachi et al. | 30/201 |
| 5,979,060 | * | 11/1999 | Holzbauer et al. | 30/201 |

FOREIGN PATENT DOCUMENTS

| | | |
|---|---|---|
| 575889C | 4/1933 | (DE) . |
| 98/25734 | 6/1998 | (WO) . |

* cited by examiner

*Primary Examiner*—Hwei-Siu Payer
(74) *Attorney, Agent, or Firm*—Ernestine C. Bartlett; Norman N. Spain

(57) ABSTRACT

In a hair-cutting system (1) including a hair-cutting apparatus (2) and including a comb device (3) at least the comb teeth (10) of the comb device (3) are connected to holding means (14) of the hair-cutting apparatus (2) with the aid of connecting means (13), and connecting means (13) are constructed to enable the angular position of the comb teeth (10) with respect of the hair-cutting apparatus (2) to be changed continually, and the connecting means (13) are further constructed and arranged in such a manner that when the comb teeth (10)are moved over a skin area of a person a continual contact with the skin area is guaranteed for the essential part of the contact zones (Z) of said comb teeth (10) by a continual adaptation of their angular position.

7 Claims, 8 Drawing Sheets

HAIR-CUTTING SYSTEM INCLUDING A HAIR-CUTTING APPARATUS AND INCLUDING A COMB SECTION WHOSE ANGULAR POSITION IS CONTINUALLY ADJUSTABLE WITH RESPECT TO THE HAIR-CUTTING POSITION

BACKGROUND OF THE INVENTION

The invention relates to a hair-cutting system including a hair-cutting apparatus for cutting hairs, said apparatus being held in a hand during operation, and having a toothed cutting device, having a comb device mounted on the hair-cutting apparatus in the area of its toothed cutting device and having juxtaposed comb teeth, said comb teeth each having a distal tooth end and a proximal tooth end and a contact zone extending between the two tooth ends, and of which at least the comb teeth are connected to holding means of the hair-cutting apparatus with the aid of connecting means, and in which system during operation at least some of the comb teeth can be applied to a skin area of a person with at least those areas of their contact zones which adjoin the distal tooth ends and can be moved over this skin area in an operating direction with their distal tooth ends facing forward.

Such a hair-cutting system of the type defined in the opening paragraph is known, for example from the patent document WO 98/25734 A1 which corresponds substantially to U.S. Pat. No. 5,898,999, assigned to U.S. Philips Corporation. In this known hair-cutting system the comb device comprises two guide member configurations which are rigidly connected to the comb teeth and which extend in a longitudinal direction of the housing of the hair-cutting apparatus, which guide members engage in guide grooves in the hair-cutting apparatus and by means of which the comb device is movably mounted with respect to the hair-cutting apparatus, so that during operation of the hair-cutting system it is simply possible to select different cutting lengths by moving the comb device. Because of the rigid connection of the two guide member configurations with the comb teeth it is necessary that, in order to guarantee a correct hair-cutting process by means of the known hair-cutting system, the hair-cutting apparatus with the comb device should always be held in such a relative position with respect to the skin area of a person that, as the comb teeth of the comb device are moved over a skin area, an optimum contact with this skin area is achieved for at least those parts of the contact zones of the comb teeth which adjoin the distal tooth ends. However, unfortunately such a contact of these parts of the contact zones of the comb teeth with a skin area depends to a large extent on the dexterity and experience of a user of the hair-cutting system. In the case of lack of experience and lack of dexterity it is not unlikely that the distal tooth ends of the comb teeth are clear of the skin area just passed, as a result of which the hairs in this area are not or not satisfactorily raised and are therefore guided unsatisfactorily towards the toothed cutting device, which results in an unsatisfactory cutting action. When the user lacks experience and/or dexterity it is also possible that the distal tooth ends of the comb teeth are applied too steeply to a skin area of a person, in which case not only those parts of the contact zones of the comb teeth which adjoin the distal tooth ends but all the contact zones of the comb teeth also are clear of the relevant skin area and the comb teeth occupy too steep positions relative to the relevant skin area, as a result of which the hairs situated in this skin area are fended off by the comb teeth, which likewise results in these hairs not being raised properly and leads to an unsatisfactory cutting action.

SUMMARY OF THE INVENTION

It is an object of the invention to preclude the aforementioned problems and to provide an improved hair-cutting system.

According to the invention, in order to achieve this object in a hair-cutting system of the type defined in the opening paragraph, the connecting means are constructed to enable the angular position of at least the comb teeth of the comb device with respect to the hair-cutting apparatus to be changed continually, and the connecting means are further constructed and arranged in such a manner that when during operation of the hair-cutting system at least some of the comb teeth are moved over a skin area a continual contact with this skin area is guaranteed for at least those parts of the contact zones of said comb teeth which adjoin the distal tooth ends by a continual change of the angular position of said comb teeth In preferred embodiments of the invention, it is achieved in a simple manner and by simple means that, as the comb teeth are passed over a skin area of a person during operation of a hair-cutting system in accordance with the invention, at least those parts of the contact zones of the comb teeth which adjoin the distal tooth ends are automatically brought into continual contact with said skin area. Thus, at least in the area of their distal ends, the comb teeth always occupy a position relative to a skin area which is advantageous for a proper raising of hairs, so that a proper raising of hairs and, consequently, a correct cutting performance is always achieved with a hair-cutting system in accordance with the invention.

In especially preferred embodiments of a hair-cutting system in accordance with the invention:

the connecting means include pivoting means with the aid of which at least the comb teeth of the comb device can be tilted with respect to the hair-cutting apparatus;

the pivoting means are formed by a pivoting spindle which extends transversely to the juxtaposed comb teeth and which is arranged adjacent the contact zones of the comb teeth;

in relation to the distal tooth ends and the proximal tooth ends of the comb teeth, the pivoting spindle is situated nearer the distal tooth ends;

the comb device includes two limbs which form parts of the connecting means and between which at least most of the comb teeth of the comb device are arranged, and the pivoting spindle is arranged at the location of a respective one of the ends of the two limbs, the two limbs engaging in guide grooves of the hair-cutting apparatus with their parts which are remote from the pivoting spindle, which grooves form parts of the holding means of the hair-cutting apparatus;

the pivoting means are formed by at least one control lever pairs which comprises two control levers, which at the location of each of their two lever ends both have a joint, two connecting lines of which each connecting line connects the two joints for a respective control lever to one another, intersect one another in an intersection point which, in relation to the contact zones of the comb teeth, is situated at that side of these contact zones which is remote from the hair-cutting apparatus;

the connecting means include at least one cam device arranged between at least one comb tooth and the holding means of the hair-cutting apparatus and comprising an at least partly curved cam slot and at least one cam follower which engages in the cam slot, the cam slot having at least one center of curvature which, in relation to the contact zones of the comb teeth is situated at that side of these contact zones which is remote from the hair-cutting apparatus;

the angular position of the entire comb device is continually adjustable with respect to the hair-cutting apparatus with the aid of connecting means; and the angular position of the toothed cutting device with respect to the hair-cutting apparatus is continually adjustable with the aid of the connecting means. The principal merits of these embodiments reside in a particularly simple construction and a high reliability.

It is to be noted that a hair-cutting system comprising a hair-cutting apparatus and a hair pressing block is known from the U.S. Pat. No. 4,557,050 and is shown in FIG. 23 of said patent document, and is described in column 6, lines 37 to 55. The hair pressing block is mounted so as to be continually pivotable with respect to the hair-cutting apparatus. The comb has pin-like comb teeth similar to a regular hair comb and is adapted merely to bring hairs in parallel alignment with one another. Furthermore, during normal operation the comb and the hair pressing roller are not adapted to be applied to a skin area of a person but to brush over hairs that lie at a comparatively large distance from a skin area, the hair pressing roller serving for holding down or pressing down hairs in order to allow only a comparatively small volume of hairs to be engaged and severed by a toothed cutting device, as is desired for example for so-called thinning of hairs, for which purpose the hair pressing block has been provided. Thus, in the hair-cutting system known from U.S. Pat No. 4,557,050 a hair pressing block which is pivotable with respect to the hair-cutting apparatus is provided no movably supported comb device is provided, the construction of the comb device and the comb teeth of the comb device is of an entirely different nature than in the comb device of the hair-cutting system in accordance with the invention, and the problem to be solved is also of an entirely other nature than in the case of the hair-cutting system in accordance with the invention.

The afore-mentioned as well as further aspects of the invention will be apparent from the embodiments described hereinafter by way of examples and will be elucidated on the basis of these embodiments.

BRIEF DESCRIPTION OF THE DRAWINGS

The invention will now be described in more detail with reference to the drawings, which show a number of embodiments which are given by way of example but to which the invention is not limited.

DESCRIPTION OF THE PREFERRED EMBODIMENTS

Figure 1:
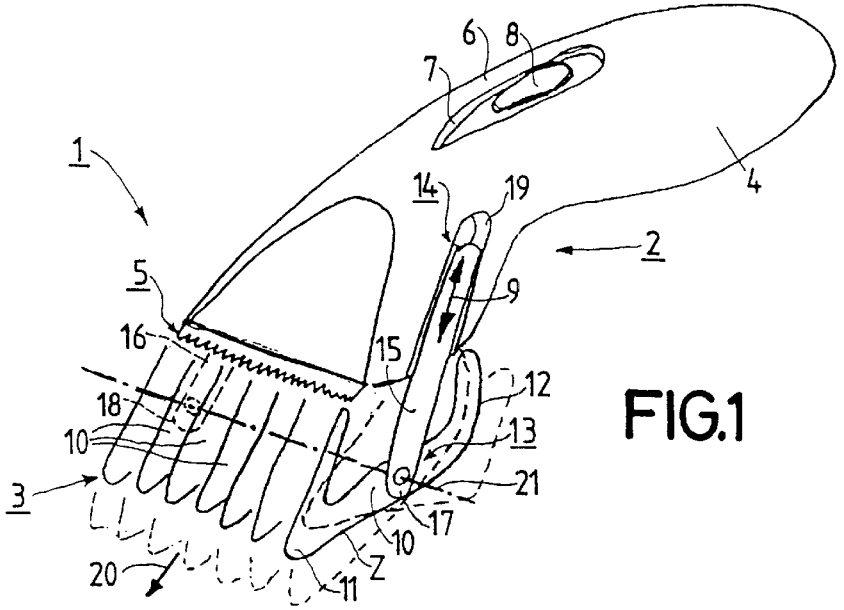
FIG. 1 is a slightly scaled-down oblique view which diagrammatically shows a hair-cutting system in accordance with a first embodiment of the invention.

FIG. 1 shows a hair-cutting system 1 in accordance with the invention. The hair-cutting system 1 comprises a hair-cutting apparatus 2 for cutting hairs and a comb device 3 for bringing hairs into an upright position. The hair-cutting apparatus 2 is held in a hand during operation of the hair-cutting system 1. The hair-cutting apparatus 2 has a housing 4, which in the present case has a slightly angular shape. At one end of the hair-cutting apparatus 2, or the housing 4, the hair-cutting apparatus 2 has a toothed cutting device 5. The housing 4 has a recess 7 in a dorsal area 6. In this recess 7 an actuating button 8 is situated, which can be slid to and from parallel to a longitudinal direction of the housing 4 and by means of which the entire comb device 3 can be positioned or moved in a direction parallel to the double arrow 9 in FIG. 1 via an actuating device not shown in FIG. 1. For the actuating button 8 and the actuating means, not shown, reference is made to the afore-mentioned patent document WO 98/25734 A1 and U.S. Pat. No. 5,898,999, which are incorporated herein by reference.

The comb device 3 is mounted on the hair-cutting apparatus 2 in the area of the toothed cutting device 5 of the apparatus so as to guide the hairs raised by it towards the toothed cutting device 5 for the purpose of severing the hairs. The comb device 3 has a plurality of juxtaposed comb teeth 10. Each of the comb teeth 10 has a distal tooth end 11 and a proximal tooth end 12 as well as a contact zone Z which extends between the two tooth ends 11 and 12. In the present case the contact zones Z are slightly concave.

In the hair-cutting system 1 shown in FIG. 1 the comb teeth 10 are connected to holding means 14 provided on the hair-cutting apparatus 2. The connecting means 13 comprise two limbs 15 and 16 between which, in the present case, all the comb teeth 10 of the comb device 3 are limbs 15 and 16 each form a part of the comb device 3 and are connected to the comb teeth 10 of the comb device 3 in the areas of their respective ends 17 and 18. The holding means 14 have two guide grooves 19, of which only one guide groove 19 is shown in FIG. 1. The two limbs 15 and 16 engage in the guide grooves 19 of the hair-cutting apparatus 2 with their parts which are remote from the two ends 17 and 18. The limbs 15 and 16 are each detachably coupled to an actuating pin at the ends remote from the two ends 17 and 18, each actuating pin forming a part of the afore-mentioned actuating means which can be actuated by the actuating button 8. Owing to the detachable coupling between the actuating pins, not shown, and the limbs 15 and 16, the entire comb device 3 can be removed from the hair-cutting apparatus 2 in the hair-cutting system 1 shown in FIG. 1, as is known per se from the hair-cutting system described in the afore-mentioned patent document WO 98/25734 A1 and U.S. Pat. No. 5,898,999.

With regard to the comb device 3 and the comb teeth 10 of the comb device 3 it is to be noted that during operation of the hair-cutting system 1 at least some of the comb teeth 10 can be applied to a skin area of a person with at least those areas of their contact zones Z which adjoin the distal toothed ends 11 and can be moved over this skin area in an operating direction with their distal tooth ends 11 facing forward. Said operating direction is indicated by an arrow 20 in FIG. 1. In order to achieve an optimum performance of the comb device 3 during operation of such a hair-cutting system 1 it is important that the comb teeth 10 and the contact zones Z of the comb teeth 10 are always in an optimum relative position with respect to a skin area over which they are moved, such an optimum relative position being obtained when the comb teeth 10 lie on such a skin area with at least those areas of their contact zones Z which adjoin the distal tooth ends 11.

The hair-cutting system 1 shown in FIG. 1 has the advantage that the connecting means 13 are constructed to enable the angular position of the comb teeth 10 of the comb device 3 with respect to the hair-cutting apparatus 2 to be changed continually. Moreover, the connecting means 13 in the hair-cutting system 1 shown in FIG. 1 are constructed and arranged in such a manner that when the comb teeth 10 are moved over a skin area during operation of the hair-cutting system 1 a continual contact with this skin is guaranteed for at least those parts of the contact zones Z of said comb teeth 10 which adjoin the distal tooth ends 11 by a continual change of the angular position, i.e. the angular position of the comb teeth 10 with respect to the hair-cutting apparatus 2 when held in a hand, and with respect to the skin area.

In the hair-cutting system 1 shown in FIG. 1, the connecting means 13 include pivoting means which enable the comb teeth 10 of the comb device 3 to be tilted with respect to the hair-cutting apparatus 2. In a particularly simple manner, the pivoting means are formed by a pivoting spindle 21, which is shown only diagrammatically in FIG. 1. The pivoting spindle 21 extends transversely to juxtaposed comb teeth 10 and the pivoting spindle 21 is arranged adjacent the contact zones Z of the comb teeth 10, which is very important for a continual change of the angular position of the comb teeth 10 and, consequently, a continual contact of at least those areas of the contact zones Z of the comb teeth 10 which adjoin the distal tooth ends 11 with a skin area. As regards the arrangement of the pivoting spindle 21 in relation to the distal tooth ends 11 and the proximal tooth ends 12 of the comb teeth 10 it is to be noted that in the present case the pivoting spindle 21 is substantially centered between the two tooth ends 11 and 12. In relation to the two limbs 15 and 16 the pivoting spindle 21 is arranged at the location of the respective ends 17 and 18 of the two limbs 15 and 16, as is also apparent from FIG. 1.

Figure 2:
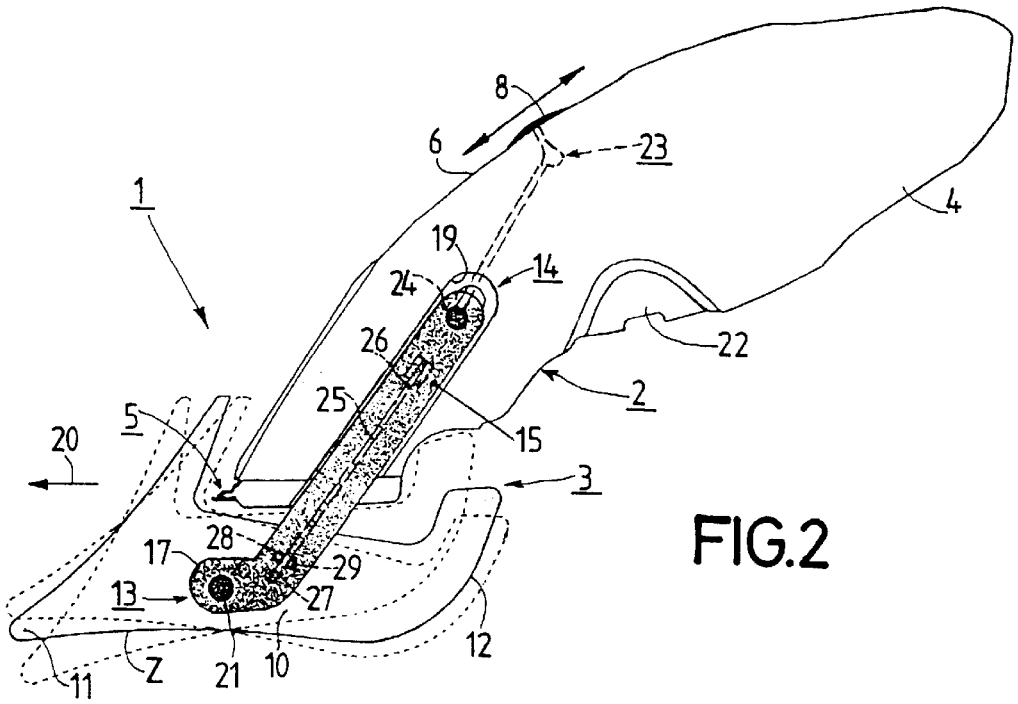
FIG. 2 is a side view of a hair-cutting system in accordance with a second embodiment of the invention, a comb device of this hair-cutting system being shown in an operating position in which it is disposed comparatively close to a hair-cutting apparatus of this hair-cutting system.
Figure 3:
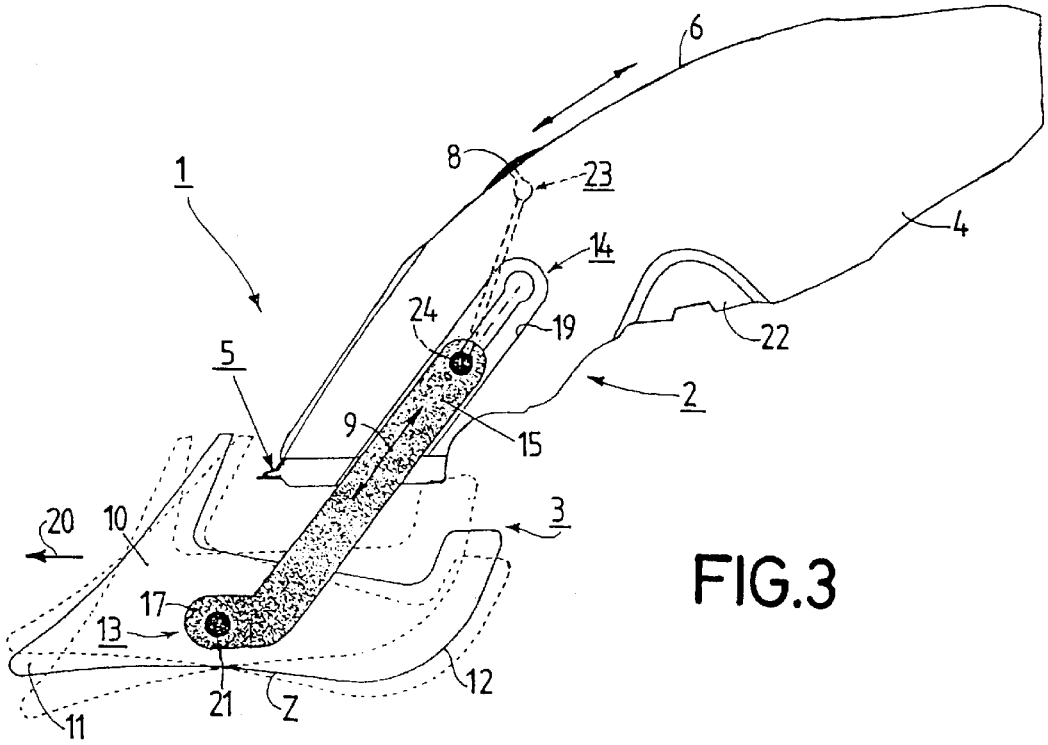
FIG. 3 shows the hair-cutting system of FIG. 2, the comb device being shown in an operating position in which it is disposed comparatively far from the hair-cutting apparatus.

FIGS. 2 and 3 show a hair-cutting system 1 in accordance with a second embodiment of the invention, which differs only slightly from the hair-cutting system 1 shown in FIG. 1. FIGS. 2 and 3 also show an on/off switch 22 of the hair-cutting apparatus 2, which serves for switching on and switching off the hair-cutting apparatus 2. Furthermore, FIGS. 2 and 3 also show diagrammatically actuating means 23, which can be actuated by means of the actuating button 8. FIGS. 2 and 3 further show actuating pins 24 which form parts of the actuating means 23 and which are detachably coupled, for example by interlocking, to the limbs 15 and 16 of the comb device 3.

FIG. 2 further shows a detail of the comb device 3 of the hair-cutting system 1. The comb device 3 comprises a rod spring 25 for each of the limbs 15 and 16, which springs have an end 26 secured to the respective limb 15 or 16 and have another end 27 interposed between two pins 28 and 29, which project from the outermost comb tooth 10. Thus, an initial position for the comb teeth 10 of the comb device 3 is defined by means of the two rod springs 25, which initial position is shown in solid lines in FIGS. 2 and 3.

In the hair-cutting system 1 shown in FIGS. 2 and 3 the two limbs 15 and 16 have angled portions at their ends 17 and 18, which angled end portions extend toward the distal tooth ends 11. The pivoting spindle 21 is arranged in the area of these angled end portions 17 and 18. As a result of the provision of the angled portions of the limbs 15 and 16 and the arrangement of the pivoting spindle 21 in the area of the end portions 17 and 18 of the limbs 15 and 16, it is achieved in a simple manner that, in relation to the distal tooth ends 11 and the proximal tooth ends 12 of the comb teeth 10, the pivoting spindle 21 is situated nearer the distal tooth ends 11. This has proved to be favorable for an optimum constant contact of the contact zones Z at the location of the distal tooth ends 11. In the hair-cutting system 1 shown in FIGS. 2 and 3 this constant contact with a skin area is also achieved by a continual change of the angular position of the comb teeth 10 with respect to the hair-cutting apparatus 2. In FIGS. 2 and 3 two such angular positions of the comb teeth 10 are shown in broken lines. These two angular positions are end positions of the comb teeth 1, which end positions are defined by stop means not shown in FIGS. 2 and 3.

Figure 4:
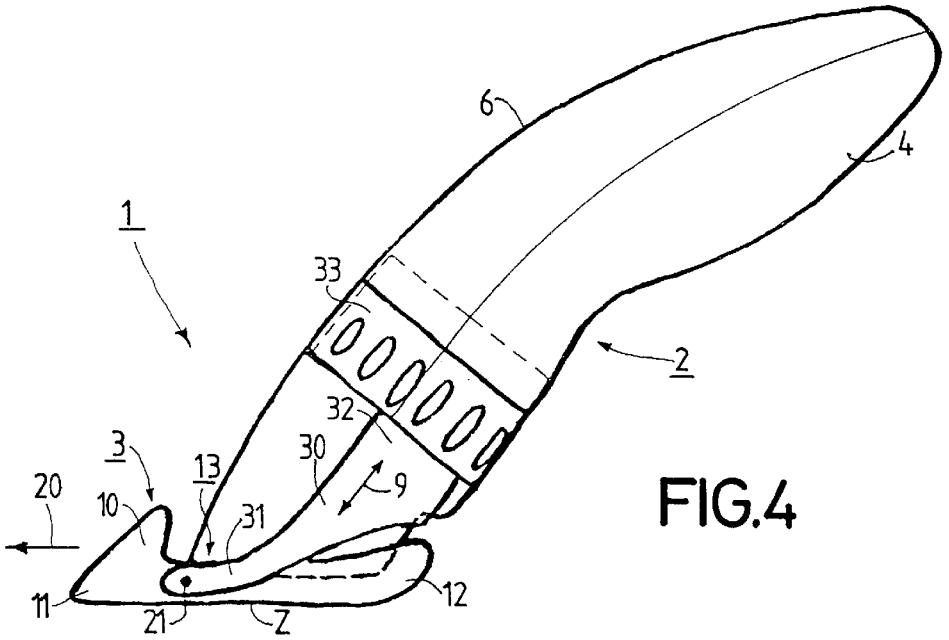
FIG. 4 is a side view of the hair-cutting system in accordance with a third embodiment of the invention.
Figure 5:
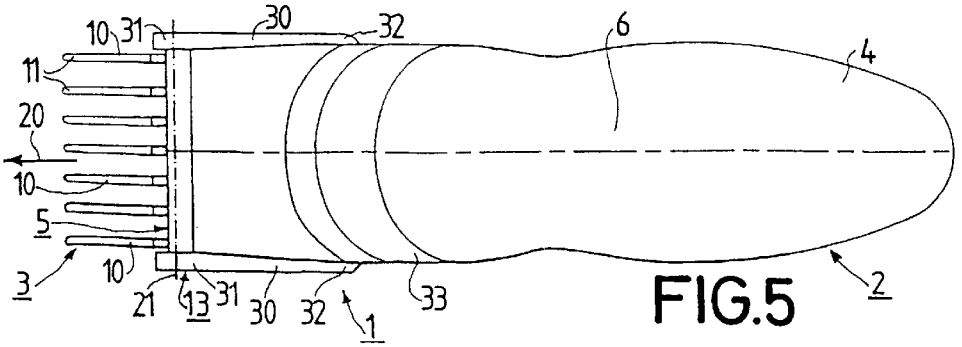
FIG. 5 shows the hair-cutting system of FIG. 4 in a plan view.

As regards the hair-cutting system 1 in accordance with the third embodiment of the invention shown in FIGS. 4 and 5, it is to be noted that this hair-cutting system 1 includes a comb device 3 whose comb teeth 10 have a substantially rectilinear contact zone Z. Also, in this case the connecting means 13 include a pivoting spindle 21. However, in the present case the connecting means 13 do not include straight limbs but they include two members 30 which each comprise a substantially platform arm 31 which extends up to the pivoting spindle 21 and a shell portion 32 whose cross-sectional shape is circular and which is integrally connected to the arm 31. Each of the two shell portions 32 is covered by an actuating ring 33 at the location of its free end, which ring is rotatable with respect to the housing 4 of the hair-cutting apparatus 2. Between the actuating ring 33 and each of the two shell portions 32 an actuating link is arranged, as a result of which it is possible by rotating the actuating ring 33 to move the member 30 parallel to the directions indicated by the double arrow 9 in order to move the comb device 3 with respect to the hair-cutting apparatus 2 and, consequently, with respect to the toothed cutting device 5 of the hair-cutting apparatus 2 for the purpose of selecting different hair-cutting lengths.

Figure 6:
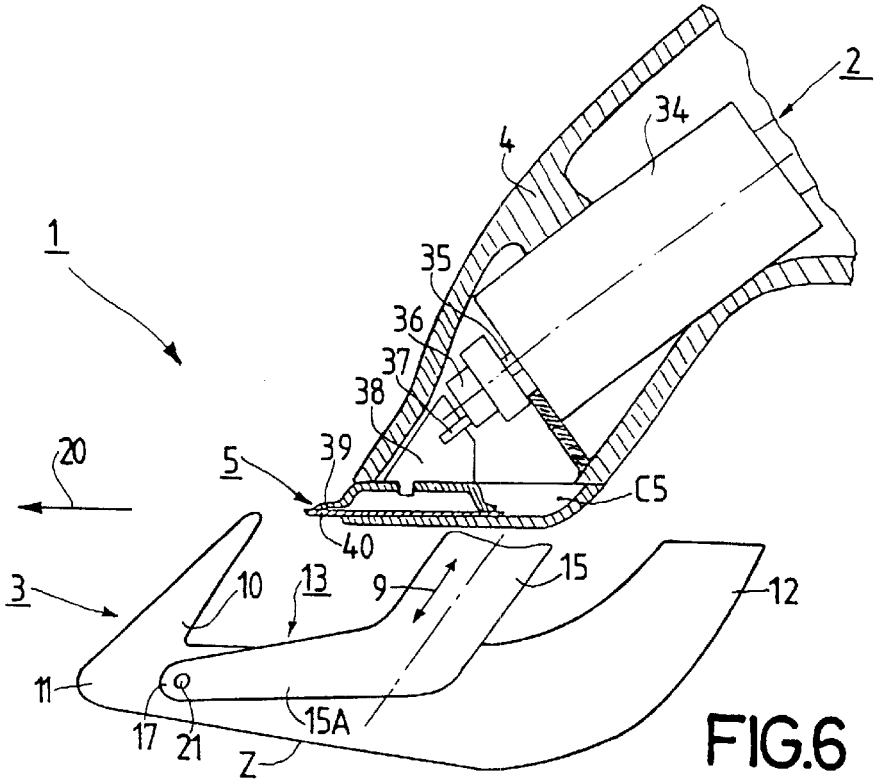
FIG. 6 diagrammatically shows a hair-cutting system in accordance with a fourth embodiment of the invention, the hair-cutting apparatus being shown in a sectional view but being shown only partly.

The hair-cutting system in accordance with the fourth embodiment of the invention shown in FIG. 6 is a variant of the hair-cutting systems 1 shown in FIGS. 1 to 5. The special feature of the hair-cutting system 1 shown in FIG. 6 essentially resides in the fact that the limbs 15 and 16, of which only the limb 15 is shown in FIG. 6, have a particularly long angled portion 15A, as a result of which the pivoting spindle 21 is situated quite close to the distal tooth ends 11 of the comb teeth 10.

As regards the hair-cutting system 1 shown in FIG. 6, it is to be noted that a drive motor 34 of the hair-cutting apparatus 2 in FIG. 6 is shown, via whose motor shaft 35 an eccentric disc 36 and an eccentric pin 37 which projects from the eccentric disc 36 can be driven. The eccentric pin 37 is disposed between two drive members 38, of which only one drive member 38 is shown in FIG. 6. The two drive members 38 are fixedly connected to a drivable toothed cutter 39 of the toothed cutting device 5 of the hair-cutting apparatus 2. The drivable toothed cutter 39 is reciprocatingly drivable with respect to a stationary toothed cutter 40 of the toothed cutting device 5 via the drive members 38. The two toothed cutters 39 and 40 of the toothed cutting device 5 are mounted on a carrier C5 for the toothed cutting device 5. The carrier C5 is connected to the housing 4 of the hair-cutting apparatus 2 via a pivotal joint, not shown, arranged at that end of the carrier C5 which is remote from the two toothed cutters 39 and 40. Thus, it is achieved that the carrier C5 together with the toothed cutting device 5 can be pivoted away from the hair-cutting apparatus 2, for example in order to enable the two toothed cutters 39 and 40 to be cleaned.

In the hair-cutting system 1 shown in FIG. 6 a particularly satisfactory performance is obtained because the pivoting spindle 21 and the distal tooth ends 11 of the comb teeth 10 are situated close to one another. As a result of this construction the continual variation of the angular position of the comb teeth 10 with respect to the hair-cutting apparatus 2 proceeds very satisfactorily and smoothly, thereby guaranteeing a constant contact of the contact zones Z of the comb teeth 10 with a skin area, even in the case of comparatively pronounced variations in curvature in the skin area being treated.

Figure 7:
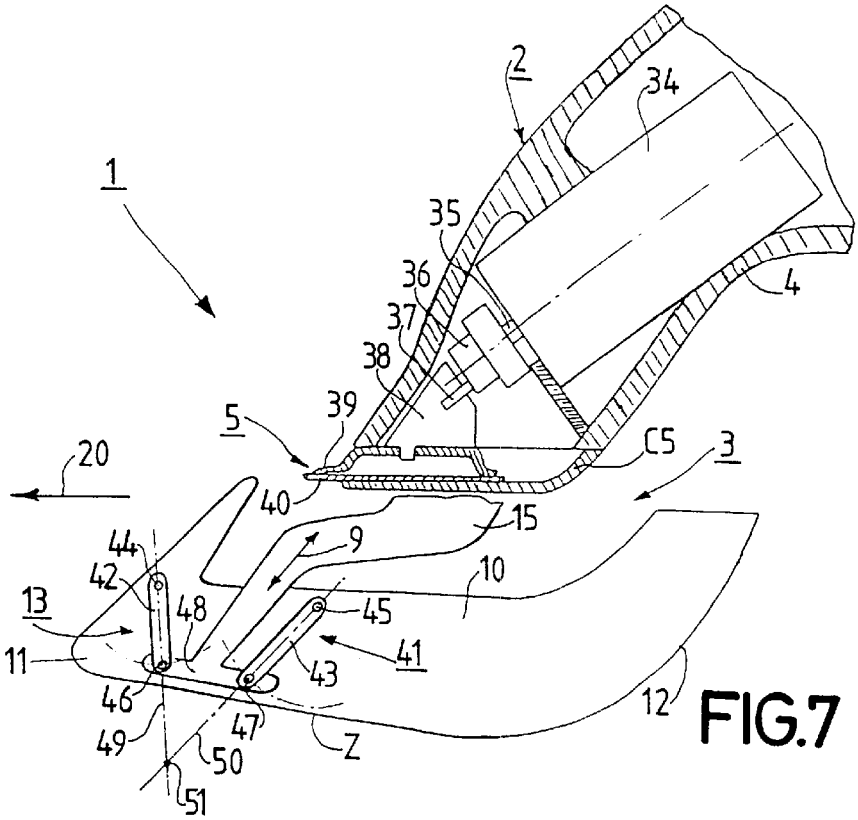
FIG. 7 shows a partial, sectional view of a hair-cutting system in accordance with a fifth embodiment of the invention.

In the hair-cutting system 1 in accordance with the fifth embodiment of the invention shown in FIG. 7, the connecting means 13 also include two limbs 15 and 16, of which only the limb 15 is shown in FIG. 7. Also in the present case, the connecting means 13 further include pivoting means. However, now the pivoting means are not formed by a pivoting spindle but by two control lever pairs 41, only one of the pairs being shown in FIG. 7. The control lever pair 41 comprises two control levers 42 and 43. The two control levers 42 and 43 are each connected to a comb tooth 10 via a respective joint 44 or 45 at the location of one of their lever ends and to a transverse portion 48 of the limb 15, and thus eventually to holding means, not shown in FIG. 7, of the hair-cutting apparatus 2 via the limb 15, via a respective further joint 46 or 47 at the location of another one of their lever ends. The two control levers 42 and 43 are arranged in such a manner that two connecting lines 49 and 50, of which each connecting line 49 or 50 connects the two joints 44 and 46 or 45 and 47 for a respective control lever 42 or 43 to one another, intersect one another in an intersection point 51 which in relation to the contact zones Z of the comb teeth 10 is situated at that side of these contact zones Z which is remote from the hair-cutting apparatus 2. Thus, the intersection point 51 defines a pivotal center for the comb teeth 10 which is situated in the free space opposite the comb teeth 10. This guarantees a particularly satisfactory and smooth movement of the comb teeth 10 as they pass over a skin area, thereby assuring a particularly reliable lasting contact of the contact zones Z with a skin area.

Figure 8:
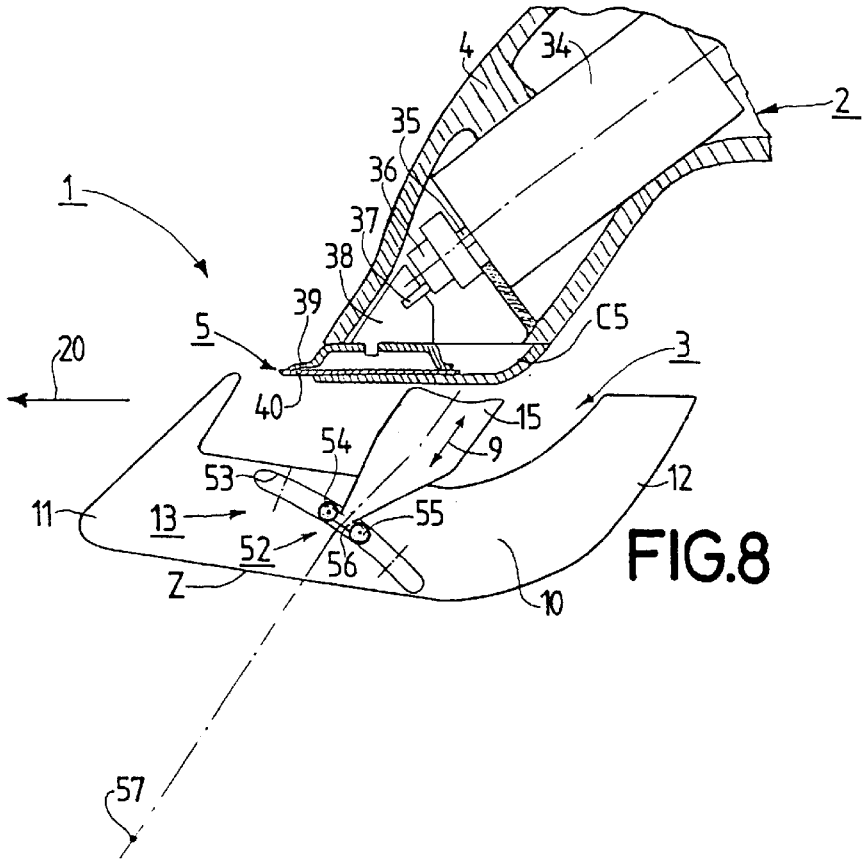
FIG. 8 shows a partial, sectional view of a hair-cutting system in accordance with a sixth embodiment of the invention.

In the hair-cutting system 1 in accordance with the sixth embodiment of the invention shown in FIG. 8 the connecting means 13 also include two limbs 15 and 16, of which only the limb 15 is shown in FIG. 8. In the present case the connecting means 13 further include two cam devices 52, of which only one cam device 52 is shown in FIG. 8. The cam device 52 comprises a curved cam slot 53 formed in a comb tooth 10 and two cam followers 54 and 55 in the form of small pins or rollers which engage in the cam slot 53 and which project laterally from a transverse portion 56 of the limb 15. Since the limb 15 is connected to holding means of the hair-cutting apparatus 2, which means are not shown in FIG. 8, the cam device 52 lies between the comb tooth 10 and the holding means, not shown, of the hair-cutting apparatus 2.

As regards the cam slot 53 it is to be noted that in the present case the cam slot 53 is shaped in accordance with an arc of circle and, consequently, has a center of curvature 57 defined by a center of a circle, which in relation to the contact zones Z of the comb teeth 10 is situated at that side of said contact zones Z which is remote from the hair-cutting apparatus 2. As can be seen in FIG. 8, the center of curvature 57 is situated at a comparatively large distance from the contact zones Z, which has proved to be particularly advantageous for a correct and smooth variation of the angular position of the comb teeth 10 with respect to the hair-cutting apparatus 2 and, consequently, for a correct and continual contact of the contact zones Z with a skin area of a person.

Figure 9:
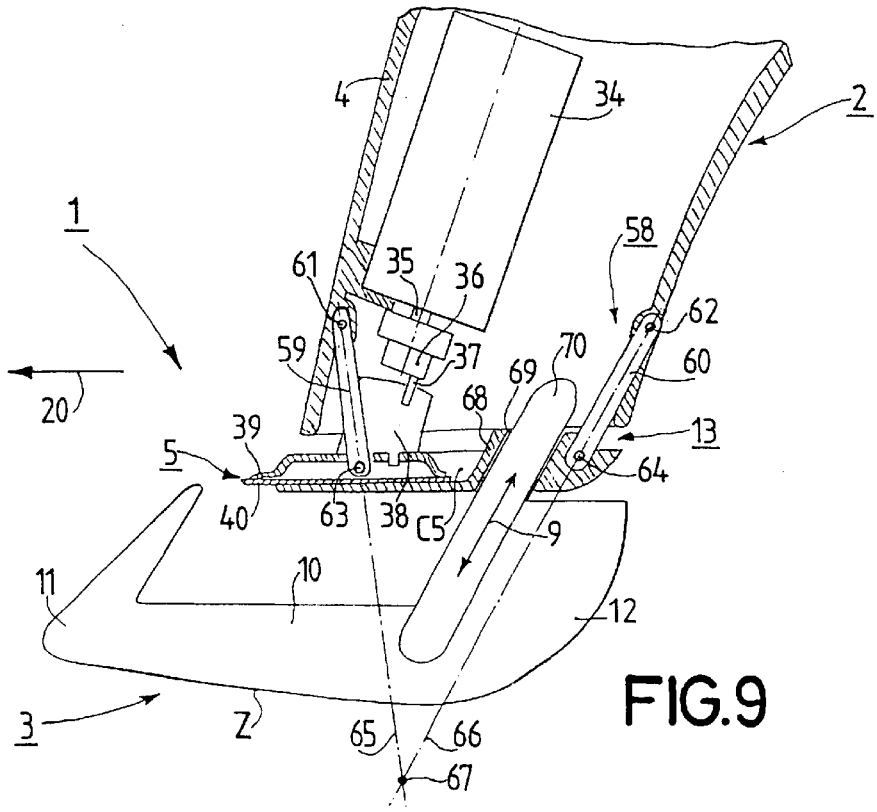
FIG. 9 shows a partial, sectional view of a hair-cutting system in accordance with a seventh embodiment of the invention.

In the hair-cutting system 1 in accordance with the seventh embodiment of the invention shown in FIG. 9 not only the angular position of the comb teeth 10 of the comb device 3 but the angular position of the entire comb device 3 is continually adjustable with respect to the hair-cutting apparatus 2 of the hair-cutting system 1 with the aid of connecting means 13. In the present case, the angular position of the toothed cutting device 5 with respect to the hair-cutting apparatus 2 is also continually adjustable with the aid of the connecting means 13. For this purpose, the construction described hereinafter has been provided in the hair-cutting system 1 shown in FIG. 9.

The hair-cutting apparatus 2 of the hair-cutting system 1 shown in FIG. 9 includes two control lever pairs 58, which form parts of the connecting means 13 and of which only one control lever pair 58 is shown in FIG. 9. The control lever pair 58 comprises two control levers 59 and 60. The two control levers 59 and 60 are each pivotally connected to the housing 4 of the hair-cutting apparatus 2 via a respective joint 61 or 62 at the location of one of their lever ends and to the carrier C5 for the hair-cutting device 5 via a respective further joint 63 or 64 at the location of another one of their lever ends. In this case, the housing 4 at the same time forms the holding means of the hair-cutting system 1. In the present case, the carrier C5 also forms a part of the connecting means 13. The two control levers 59 and 60 are arranged in such a manner that two connecting lines 65 and 66, of which each respective connecting line 65 or 66 connects the two joints 61 and 63 or 62 and 64 for a respective control lever 59 or 60 to one another, intersect one another in an intersection point 67 which, in relation to the contact zones Z of the comb teeth 10, is situated at that side of these contact zones Z which is remote from the hair-cutting apparatus 2.

The carrier C5 for the toothed cutting device 5 carries two guide sleeves 68 which each have a guide channel 69, of which only one guide channel 69 is shown in FIG. 9. Each guide channel 69 is engaged by a limb 70 of the comb device 3. In the present case, the two limbs 70 are rigidly connected to the teeth 10 of the comb device 3. The two limbs 70 slidably engage in the guide channels 69 and the two limbs 70 cooperate with actuating means, not shown, by which the two limbs 70 and, consequently, the entire comb device 3 are movable parallel to the directions indicated by the double arrow 9 so as to allow the hair-cutting system 1 to be set to different hair-cutting lengths.

Figure 10:
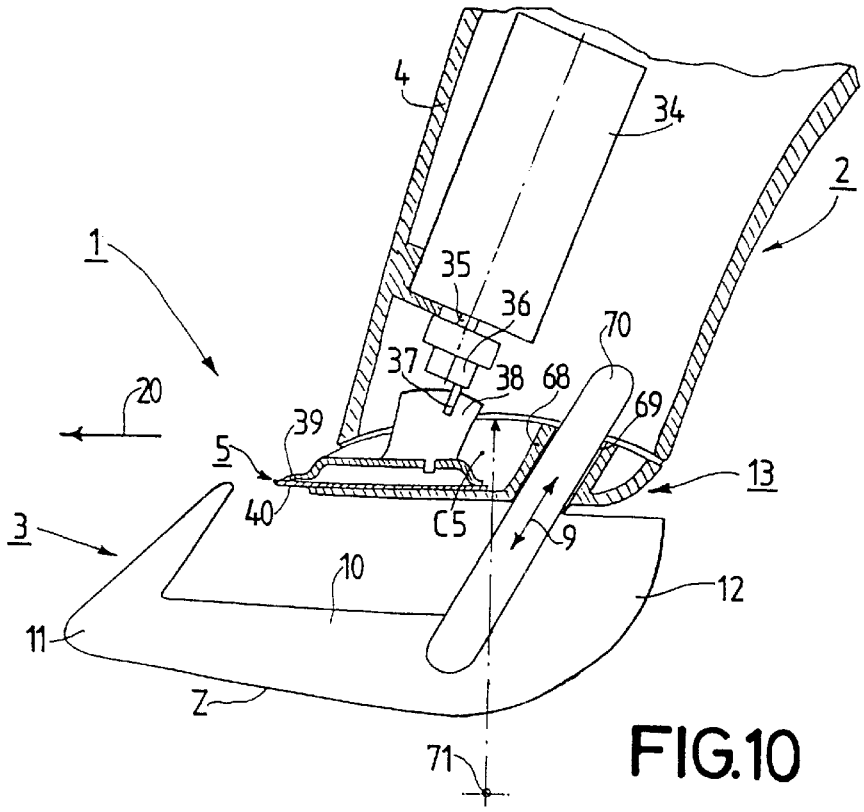
FIG. 10 shows a partial, sectional view of a hair-cutting system in accordance with an eighth embodiment of the invention.

The hair-cutting system 1 in accordance with the eighth embodiment of the invention shown in FIG. 10 is a variant of the hair-cutting system 1 shown in FIG. 9. In the hair-cutting system 1 shown in FIG. 10 the carrier C5 for the toothed cutting device 5 is mounted so as to be pivotable with respect to the housing 4 of the hair-cutting apparatus 2 with the aid of pivoting means, not shown, about a pivoting center 71 which, in relation to the contact zones Z of the comb teeth 10 of the comb device 3, is situated at that side of these contact zones Z which is remote from the hair-cutting apparatus 2. The pivoting means mentioned hereinbefore but not shown form a part of the connecting means 13, which in the present case also includes the carrier C5 for the toothed cutting device 5. The comb device 3 is mounted on the carrier C5 so as to be pivotable, namely in the same way as in the hair-cutting system 1 shown in FIG. 9. In this case, the housing 4 at the same time constitutes the holding means of the hair-cutting system 1.

Figure 11:
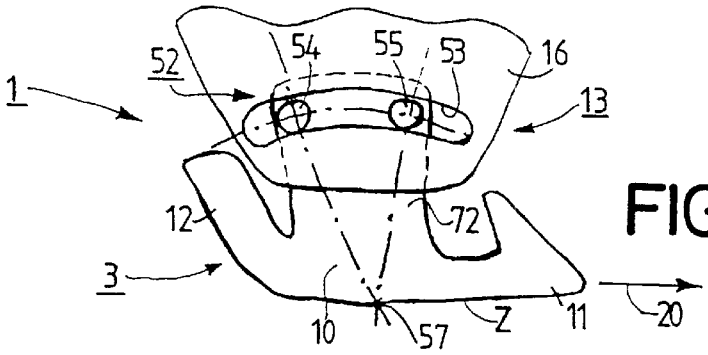
FIG. 11 diagrammatically shows a part of a hair-cutting system in accordance with a ninth embodiment of the invention.

FIG. 11 shows a part of a hair-cutting system 1 in accordance with a ninth embodiment of the invention, which is a variant of the hair-cutting system 1 shown in FIG. 8. In the hair-cutting system 1 shown in FIG. 1 the connecting means 13 also include at least one cam device 52 arranged between a comb tooth 10 and the holding means of the hair-cutting apparatus, which cam device comprises a curved cam slot 53 and two pin-shaped cam followers 54 and 55 which engage in the cam slot 53. However, in this case the cam slot 53 is formed in a limb 16 of the connecting means 13 and the pin-shaped cam followers 54 and 55 project from an extension 72 of a comb tooth 10, which extension has been provided in order to carry the two cam followers 54 and 55. In the hair-cutting system 1 shown in FIG. 11 the cam slot 53 is curved in accordance with an arc of circle and consequently has only one center of curvature 57, which in relation to the contact zones Z of the comb teeth 10 lies substantially in the area of these contact zones Z in the present case.

Figure 12:
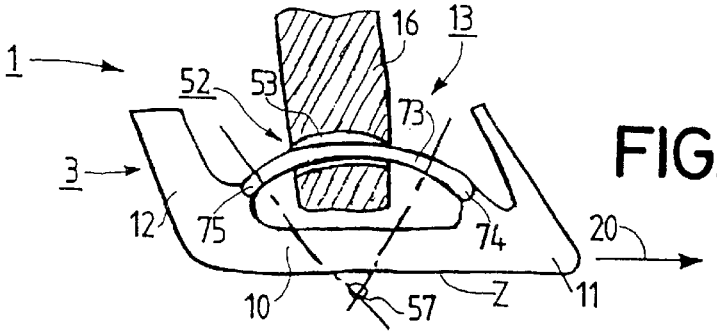
FIG. 12 diagrammatically shows, a part of a hair-cutting system in accordance with a tenth embodiment of the invention.

FIG. 12 shows a part of a hair-cutting system 1 in accordance with a tenth embodiment of the invention. This embodiment is a variant or modification of the hair-cutting system 1 shown in FIG. 11. In the hair-cutting system 1 shown in FIG. 12 the connecting means 13 also include a cam device 52 arranged between a comb tooth 10 and the holding means, not shown, of the hair-cutting apparatus of the hair-cutting system 1. Also in this case, a cam slot 53 shaped in accordance with an arc of circle is formed in a limb 16 of the connecting means 13. This cam slot 53 is engaged by a cam follower which takes the form of a connecting limb 73 shaped in accordance with an arc of circle as the cam follower of the cam device 52. Both ends 74 and 75 of the connecting limb 73 are connected to a comb tooth 10. Since the cam slot 53 and the connecting member 73 forming the cam follower have the shape of an arc of circle again only one center of curvature 57 is defined which in the present case, in relation to the contact zones Z of the comb teeth 10, lies substantially at that side of these contact zones Z which is remote from the hair-cutting apparatus of the hair-cutting system 1.

Figure 13:
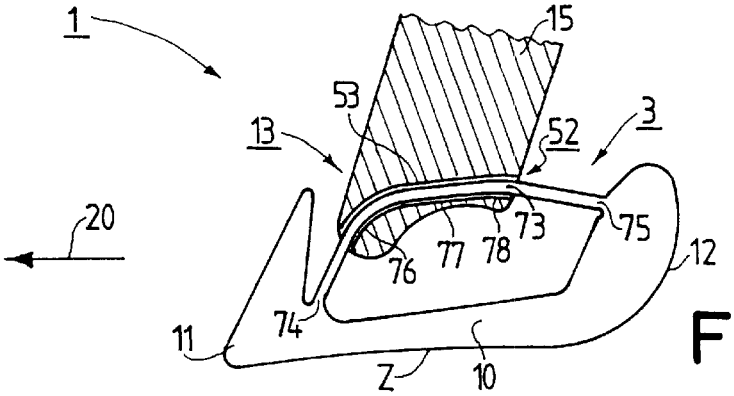
FIG. 13 diagrammatically shows, a part of a hair-cutting system in accordance with an eleventh embodiment of the invention.

FIG. 13 shows a part of a hair-cutting system 1 in accordance with an eleventh embodiment of the invention. This hair-cutting system 1 is a variant of the hair-cutting system 1 shown in FIG. 12. In the hair-cutting system 1 shown in FIG. 13 the connecting means 13 also include a cam device 52. In this case, the cam device 52 is arranged between a plurality of comb teeth 10 and the holding means, not shown in FIG. 13, of the hair-cutting apparatus of the hair-cutting system 1. The cam device 52 now comprises a partly curved cam slot 53 and a connecting limb 73 forming a cam follower which engages the cam slot 53. The connecting limb 73 is substantially non-flexible in its longitudinal direction but is flexible, i.e. resilient, in a direction transverse to its longitudinal axis. In the present case, the cam slot 53 is not shaped in accordance with a single arc of circle but the cam slot 53 comprises a first part 76 shaped in accordance with an arc of circle, a second part 77 having a rectilinear shape, and a third part 78 shaped in accordance with an arc of circle, the part 76 having a more pronounced curvature than the part 78, as a result of which the cam device 52 no longer has a single center of curvature. Consequently, during a change of their angular position with respect to the hair-cutting apparatus the comb teeth 10 do not perform a pure pivoting movement but a movement which comprises a pivoting component and a translatory component.

Figure 14:
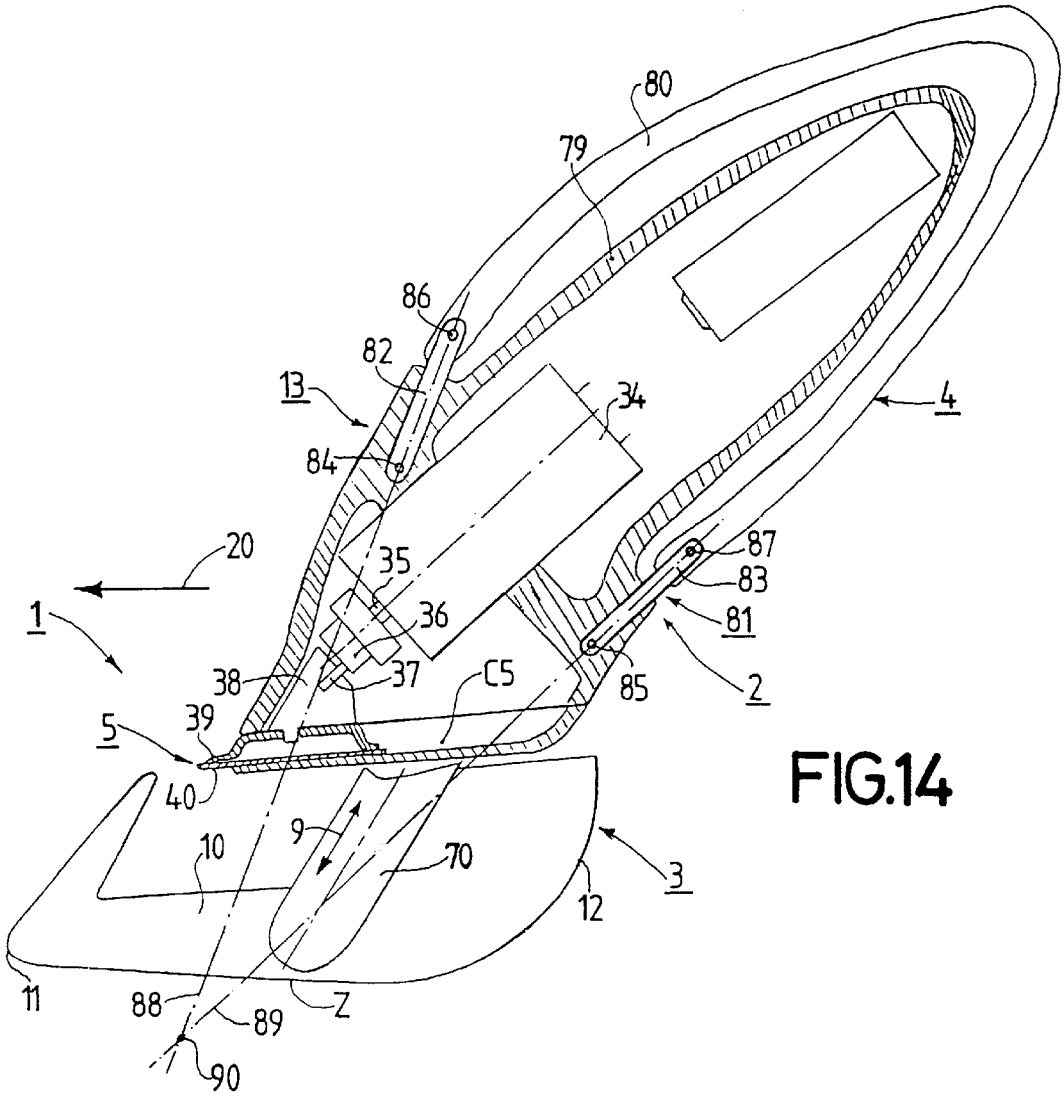
FIG. 14 diagrammatically shows, a hair-cutting system in accordance with a twelfth embodiment of the invention.

In the hair-cutting system 1 in accordance with the twelfth embodiment of the invention shown in FIG. 14 the housing 4 of the hair-cutting apparatus 2 comprises two housing parts 79 and 80. The first housing part 79 basically corresponds to the housing 4 of the hair-cutting apparatus 2 of the hair-cutting systems as shown in FIGS. 1 to 13. The second housing part 80 forms a sleeve-like enclosure for a portion of the first housing part 79. During operation of the hair-cutting system 1 shown in FIG. 14 the second housing part 80 is held in one hand.

As can be seen in FIG. 14, a control lever pair 81 comprising two control levers 82 and 83 is arranged between the first housing part 79 and the second housing part 80 to form the pivoting means. in the hair-cutting system 1. The two control levers 82 and 83 are each pivotally connected to the first housing part 79 via a respective joint 84 or 85 at the location of one of their lever ends and to the second housing part 80 via a respective further joint 86 or 87 at the location of another one of their lever ends. In this case, the housing 4 at the same time forms the holding means of the hair-cutting system 1. The two control levers 82 and 83 are arranged in such a manner that two connecting lines 88 and 89, of which each respective connecting line 88 or 89 connects the two joints 84 and 86 or 85 and 87 for a respective control lever 82 or 83 to one another, intersect one another in an intersection point 90 which, in relation to the contact zones Z of the comb teeth 10, is situated at that side of these contact zones Z which is remote from the hair-cutting apparatus 2. In the hair-cutting system 1 shown in FIG. 14 the second housing part 80 forms the holding means of the hair-cutting system 1 and the connecting means include the control lever pair 81, the first housing part 79 and the limbs 70 of the comb device 3.

Figure 15:
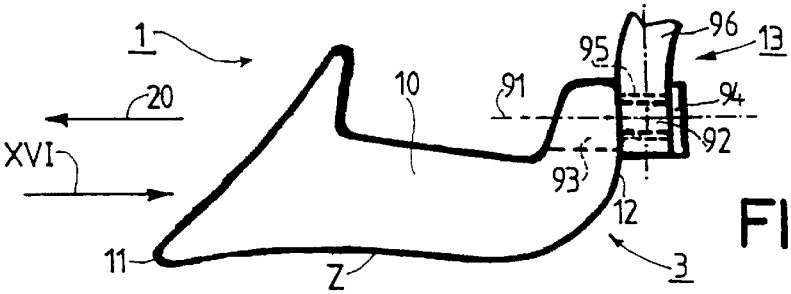
FIG. 15 diagrammatically shows a part of a hair-cutting system in accordance with a thirteenth embodiment of the invention.
Figure 16:
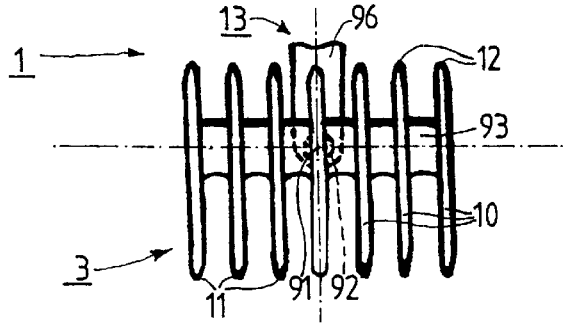
FIG. 16 shows the part of the hair-cutting system of FIG. 15 in a view as indicated by the arrow XVI in FIG. 15.

The hair-cutting system in accordance with the thirteenth embodiment of the invention shown in FIGS. 15 and 16 includes connecting means 13 which enable the angular position of the comb teeth 10 with respect to the hair-cutting apparatus, which is not shown in FIGS. 15 and 16, to be changed continually by a pivotal movement of the comb device 3 about a pivoting axis which extends substantially parallel to the operating direction 20. For this purpose, the connecting means 13 include pivoting means which comprise a bearing pin 92 whose pin axis 91 corresponds to said pivoting axis and consequently extends parallel to the operating direction 20. The bearing pin 92 projects from a web 93 which interconnects the comb teeth 10. At the location of its end which is remote from the comb teeth 10 the bearing pin 92 is connected to an end disc 94, namely by means of an ultrasonic weld. The bearing pin 92 engages a bore 95. The bore 95 has been formed in a connecting arm 96 which forms part of the connecting means 13 and which is connected to holding means of the hair-cutting apparatus, not shown.

Thus, also in this hair-cutting system 1 the connecting means 13 have a construction and arrangement which guarantees that as during operation of the hair-cutting system 1 at least some of the comb teeth 10 are moved over a skin area at least those parts of the contact zones Z of these comb teeth 10 which adjoin the distal tooth ends 11 are in continual contact with said skin area as a result of a continual change of the angular position of these comb teeth due to the pivoting movement about the bearing pin 92.

Figure 17:
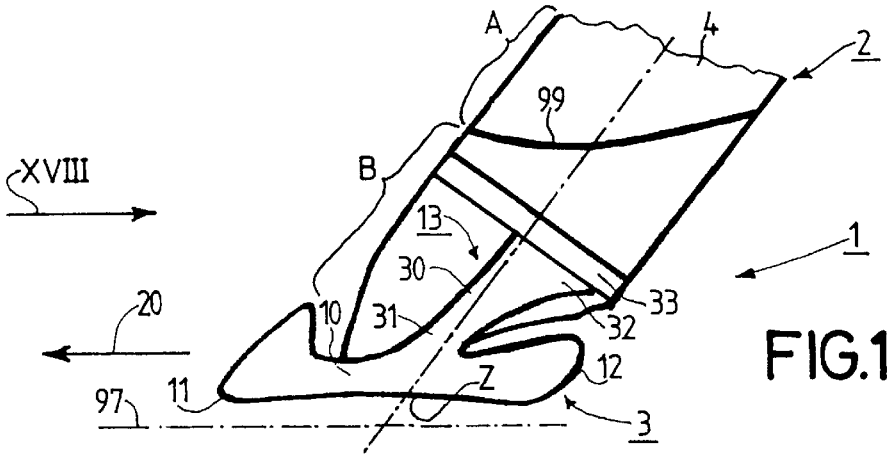
FIG. 17 shows a part of a hair-cutting system in accordance with a fourteenth embodiment of the invention.
Figure 18:
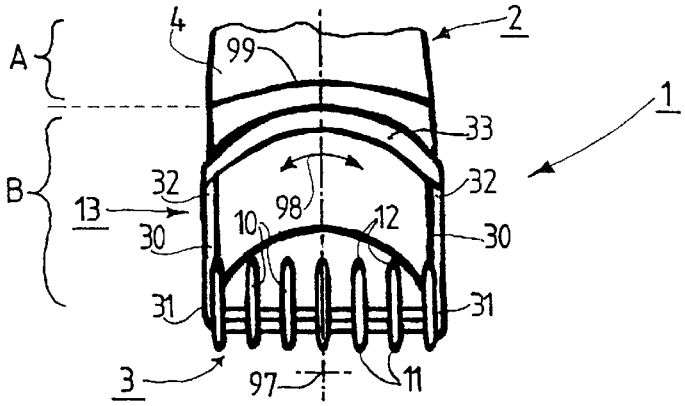
FIG. 18 shows the part of the hair-cutting system of FIG. 17 in a view as indicated by the arrow XVIII in FIG. 17.

In the hair-cutting system 1 in accordance with the fourteenth embodiment of the invention shown in FIGS. 17 and 18, a part A of the hair-cutting apparatus 2, indicated by a bracket, and a part B of the hair-cutting apparatus 2, indicated by a further bracket, are mounted so as to be pivotable with respect to one another with the aid of pivoting means, not shown, of the connecting means 13, namely in such a manner that when the part A of the hair-cutting apparatus 2 is held in one hand the part B of the hair-cutting apparatus 2 can be tilted about a pivoting axis 97 shown as a dash-dot line, which is indicated by means of the curved double-headed arrow 98 in FIG. 18. The part A and the part B of the hair-cutting apparatus 2 then adjoin one another in a separating zone 99. The geometrical shape of the separating zone 99 is a surface of cut between a circular cylinder whose cylinder axis is defined by the pivoting axis 97 and the hair-cutting apparatus 2 and the housing 4 of the hair-cutting apparatus 2 respectively.

Figure 19:
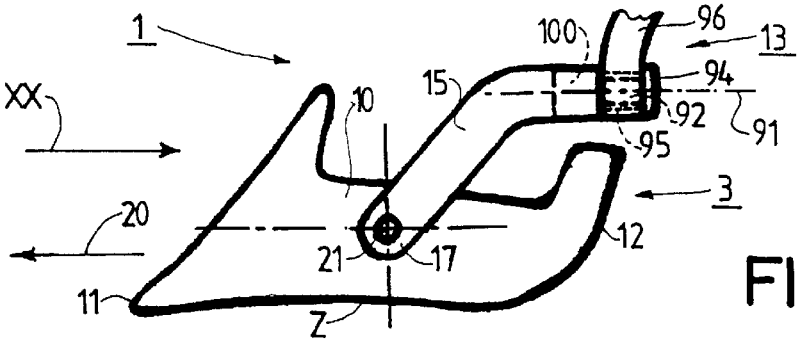
FIG. 19 diagrammatically shows a part of a hair-cutting system in accordance with a fifteenth embodiment of the invention.
Figure 20:
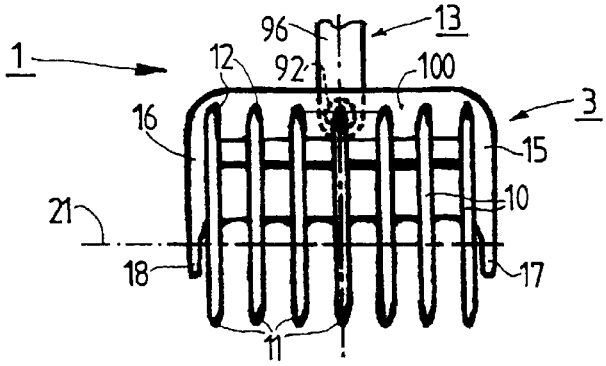
FIG. 20 shows the part of the hair-cutting system of FIG. 19 in a view as indicated by the arrow XX in FIG. 19.

In the hair-cutting system 1 in accordance with the fifteenth embodiment of the invention shown in FIGS. 19 and 20 the connecting means 13 have such a construction that the comb device 3 can perform a three-dimensional movement with respect to the hair-cutting apparatus 2, not shown, which movement has become possible in that the connecting means have been provided with suitably constructed pivoting means. In the hair-cutting system 1 shown in FIGS. 19 and 20 the pivoting means have a pivotal axis 21 which extends transversely to the juxtaposed comb teeth 10 and which is situated adjacent the contact zones Z of the comb teeth 10 and also have a bearing pin 92 whose pin axis 91 extends substantially parallel to the operating direction 20. The bearing pin 21 is arranged at the location of the ends 17 and 18 of two limbs 15 and 16, the two limbs 15 and 16 being interconnected by a member 100. The bearing pin 92 projects from the member 100.

The construction described above has the advantage that the comb teeth 10 of the comb device 3 can perform a wobbling movement, which enables a manifold change of the angular position of the comb teeth 10 and thereby also ensures that even in difficult situations at least those parts of the contact zones Z of the comb teeth 10 which adjoin the distal tooth ends 11 are in continual contact with the skin area.

Figure 21:
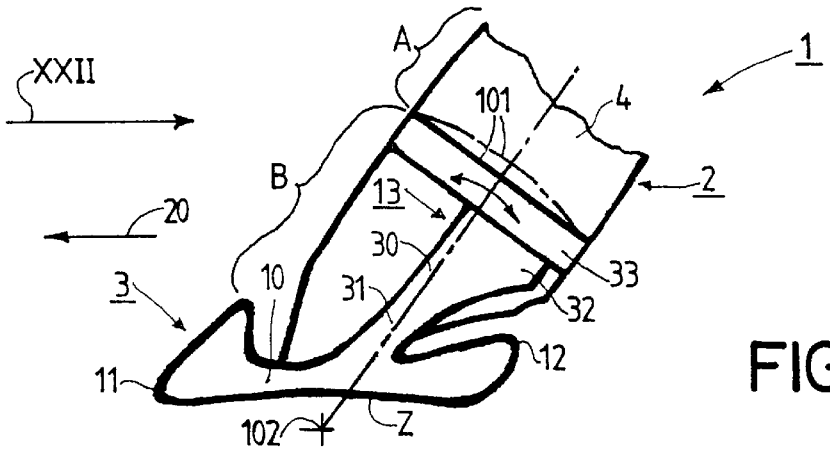
FIG. 21 diagrammatically shows a part of a hair-cutting system in accordance with a sixteenth embodiment of the invention.
Figure 22:
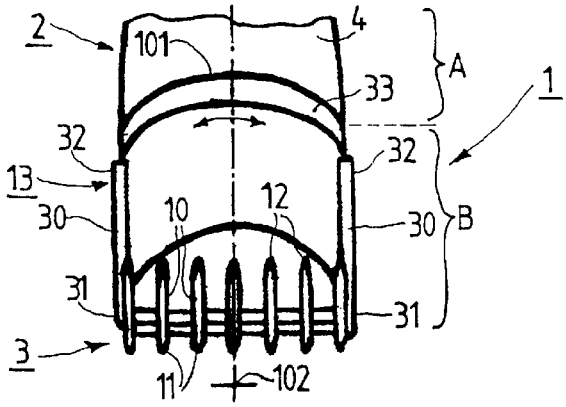
FIG. 22 shows the part of the hair-cutting system of FIG. 21 in a view as indicated by the arrow XXII in FIG. 21.

In the hair-cutting system 1 in accordance with the sixteenth embodiment of the invention shown in FIGS. 21 and 22 a separating surface 101 has been provided between a part A of the hair-cutting apparatus 2 and a part B of the hair-cutting apparatus 2, which separating surface forms a part of a surface of a sphere, whose center 102 is shown in FIGS. 21 and 22. In this hair-cutting system 1 the connecting means 13 have pivoting means which enable the part B of the hair-cutting apparatus 1 to perform a pivotal movement with respect to the part A of the hair-cutting in accordance with the spherical surface of cut 101. These connecting means 13, i.e. the pivoting means included in these pivoting means, have the advantage that the part B of the hair-cutting apparatus 2 can perform a wobbling movement with respect to the part A of the hair-cutting apparatus 2. As a result, with this hair-cutting system 1 also a particularly satisfactory continual contact with a skin area is assured for at least those parts of the contact zones Z of the comb teeth 10 which adjoin the distal tooth ends 11.

In all the hair-cutting systems 1 described hereinbefore it is achieved in a simple manner and by simple means that, as the comb teeth 10 are passed over a skin area of a person during operation, at least those parts of the contact zones Z of the comb teeth 10 which adjoin the distal tooth ends 11 are automatically brought into continual contact with said skin area, even in the case that comparatively pronounced variations in curvature occur in the skin area over which the comb teeth 10 are passed, as for example in the case of the scalp of a person. Owing to the continual contact of the essential parts of the contact zones Z of the comb teeth 10 with a skin area being treated, it is guaranteed that the comb teeth always occupy a position relative to such a skin area which is advantageous for a proper raising of hairs, so that always a proper raising of hairs and, consequently, a correct cutting performance is achieved.

What is claimed is:

1. A hair-cutting system including a hair-cutting apparatus for cutting hairs, said apparatus being held in a hand during operation, having a toothed cutting device, having a comb device mounted on the hair-cutting apparatus in the area of the toothed cutting device, and having juxtaposed comb teeth, each of said comb teeth having a distal tooth end and a proximal tooth end and a contact zone extending between the two tooth ends, and of which at least the comb teeth are connected to a holding member of the hair-cutting apparatus with the aid of connecting members, and in which system during operation at least some of the comb teeth can be applied to a skin area of a person with at least those areas of their contact zones which adjoin the distal tooth ends and can be moved over this skin area in an operating direction, wherein the connecting members:

(a) are constructed to enable the angular position of at least the comb teeth of the comb device with respect to the hair-cutting apparatus to be changed continually;

(b) include pivoting members with the aid of which at least the comb teeth of the comb device can be tilted with respect to the hair-cutting apparatus, the pivoting members being formed by at least one control lever pair which comprises two control levers, which at the location of each of their two lever ends both have a joint, two connecting lines each of which connects the two joints for a respective control lever to one another, intersect one another in an intersection point which, in relation to the contact zones of the comb teeth, is situated at that side of these contact zones which is remote from the hair-cutting apparatus, and (c) are arranged in such a manner that when during operation of the hair-cutting system at least some of the comb teeth are moved over a skin area, continual contact with this skin area is guaranteed for at least those parts of the contact zones of said comb teeth which adjoin the distal tooth ends by a continual change of the angular position of said comb teeth.

2. A hair-cutting system including a hair-cutting apparatus for cutting hairs, said apparatus being held in a hand during operation, having a toothed cutting device, having a comb device mounted on the hair-cutting apparatus in the area of the toothed cutting device, and having juxtaposed comb teeth, each of said comb teeth having a distal tooth end and a proximal tooth end and a contact zone extending between the two tooth ends, and of which at least the comb teeth are connected to a holding member of the hair-cutting apparatus with the aid of connecting members, and in which system during operation at least some of the comb teeth can be applied to a skin area of a person with at least those areas of their contact zones which adjoin the distal tooth ends and can be moved over this skin area in an operating direction, wherein the connecting members:

(a) are constructed to enable the angular position of at least the comb teeth of the comb device with respect to the hair-cutting apparatus to be changed continually;

(b) include pivoting members with the aid of which at least the comb teeth of the comb device can be tilted with respect to the hair-cutting apparatus, the pivoting members being formed by a pivoting spindle which extends transversely to the juxtaposed comb teeth and which is arranged adjacent the contact zones of the comb teeth; and (c) are arranged in such a manner that when during operation of the hair-cutting system at least some of the comb teeth are moved over a skin area, continual contact with this skin area is guaranteed for at least those parts of the contact zones of said comb teeth which adjoin the distal tooth ends by a continual change of the angular position of said comb teeth.

3. A hair-cutting system as claimed in claim 2, wherein, in relation to the distal tooth ends and the proximal tooth ends of the comb teeth, the pivoting spindle is situated nearer the distal tooth ends.

4. A hair-cutting system as claimed in claim 2, wherein the comb device includes two limbs which form parts of the connecting members and between which at least most of the comb teeth of the comb device are arranged, and the pivoting spindle is arranged at the location of a respective one of the ends of the two limbs, the two limbs engaging in guide grooves of the hair-cutting apparatus with their parts which are remote from the pivoting spindle, which grooves form parts of the holding members of the hair-cutting apparatus.

5. A hair-cutting system including a hair-cutting apparatus for cutting hairs, said apparatus being held in a hand during operation, having a toothed cutting device, having a comb device mounted on the hair-cutting apparatus in the area of the toothed cutting device, and having juxtaposed comb teeth, each of said comb teeth having a distal tooth end and a proximal tooth end and a contact zone extending between the two tooth ends, and of which at least the comb teeth are connected to a holding member of the hair-cutting apparatus with the aid of connecting members, and in which system during operation at least some of the comb teeth can be applied to a skin area of a person with at least those areas of their contact zones which adjoin the distal tooth ends and can be moved over this skin area in an operating direction, wherein the connecting members:

(a) are constructed to enable the angular position of at least the comb teeth of the comb device with respect to the hair-cutting apparatus to be changed continually;

(b) are arranged in such a manner that when during operation of the hair-cutting system at least some of the comb teeth are moved over a skin area, continual contact with this skin area is guaranteed for at least those parts of the contact zones of said comb teeth which adjoin the distal tooth ends by a continual change of the angular position of said comb teeth; and (c) include at least one cam device arranged between at least one comb tooth and the holding member of the hair-cutting apparatus and comprises an at least partly curved cam slot and at least One cam follower which engages in the cam slot, the cam slot having at least one center of curvature which, in relation to the contact zones of the comb teeth is situated at that side of these contact zones which is remote from the hair-cutting apparatus.

6. A hair-cutting system including a hair-cutting apparatus for cutting hairs, said apparatus being held in a hand during operation, having a toothed cutting device, having a comb device mounted on the hair-cutting apparatus in the area of the toothed cutting device, and having juxtaposed comb teeth, each of said comb teeth having a distal tooth end and a proximal tooth end and a contact zone extending between the two tooth ends, and of which at least the comb teeth are connected to a holding member of the hair-cutting apparatus with the aid of connecting members, and in which system during operation at least some of the comb teeth can be applied to a skin area of a person with at least those areas of their contact zones which adjoin the distal tooth ends and can be moved over this skin area in an operating direction, wherein the connecting members:

(a) are constructed to enable the angular position of at least the comb teeth of the comb device with respect to the hair-cutting apparatus to be changed continually;

(b) include pivoting members with the aid of which at least the comb teeth of the comb device can be tilted with respect to the hair-cutting apparatus, the pivoting members including a bearing pin whose pin axis extends substantially parallel to the operating direction; and (c) are arranged in such a manner that when during operation of the hair-cutting system at least some of the comb teeth are moved over a skin area, continual contact with this skin area is guaranteed for at least those parts of the contact zones of said comb teeth which adjoin the distal tooth ends by a continual change of the angular position of said comb teeth.

7. A hair-cutting system including a hair-cutting apparatus for cutting hairs, said apparatus being held in a hand during operation, having a toothed cutting device, having a comb device mounted on the hair-cutting apparatus in the area of the toothed cutting device, and having juxtaposed comb teeth, each of said comb teeth having a distal tooth end and a proximal tooth end and a contact zone extending between the two tooth ends, and of which at least the comb teeth are connected to a holding member of the hair-cutting apparatus with the aid of connecting members, and in which system during operation at least some of the comb teeth can be applied to a skin area of a person with at least those areas of their contact zones which adjoin the distal tooth ends and can be moved over this skin area in an operating direction, wherein the connecting members:

(a) are constructed to enable the angular position of at least the comb teeth of the comb device with respect to the hair-cutting apparatus to be changed continually;

(b) include pivoting members with the aid of which at least the comb teeth of the comb device can be tilted with respect to the hair-cutting apparatus, the pivoting members including a pivoting spindle which extends transversely to the juxtaposed comb teeth and which is situated adjacent the contact zones of the comb teeth, and a bearing pin whose pin axis extends substantially parallel to the operating direction; and (c) are arranged in such a manner that when during operation of the hair-cutting system at least some of the comb teeth are moved over a skin area, continual contact with this skin area is guaranteed for at least those parts of the contact zones of said comb teeth which adjoin the distal tooth ends by a continual change of the angular position of said comb teeth.

* * * * *